US005142801A

United States Patent [19]

Feller

[11] Patent Number: 5,142,801

[45] Date of Patent: Sep. 1, 1992

[54] LEVEL LIFT FRAMEWORK FOR CANISTER TYPE PLOW PUSH FRAME

[75] Inventor: Richard L. Feller, Monroe, Wis.

[73] Assignee: Monroe Truck Equipment, Inc., Monroe, Wis.

[21] Appl. No.: 756,434

[22] Filed: Sep. 9, 1991

[51] Int. Cl.[5] ..... E01H 5/04

[52] U.S. Cl. ..... 37/235; 37/232; 37/270

[58] Field of Search ..... 37/231, 232, 235, 236, 37/266, 270

[56] References Cited

U.S. PATENT DOCUMENTS 2,614,344 10/1952 Rust ..... 37/231 X
3,250,026 5/1966 Jocher et al. ..... 37/232
3,285,625 11/1966 Krieger ..... 37/231 X
3,987,562 10/1976 Deen et al. ..... 37/231 X
4,597,202 7/1986 Weeks ..... 37/232
4,976,054 12/1990 Jones ..... 37/235

*Primary Examiner*—Dennis L. Taylor
*Assistant Examiner*—Arlen L. Olsen
*Attorney, Agent, or Firm*—Kajane McManus

[57] ABSTRACT

The framework engages to a canister type push frame of a plow and extends upwardly therefrom, and forwardly therefrom along a rear surface of a plow blade centered along the length of the plow blade. The framework includes centered chain engaging structure which is forward of a forward tilt pivot point for the plow blade and includes structure for engaging the canister type actuator for the plow blade as well.

11 Claims, 1 Drawing Sheet

FIG. 1
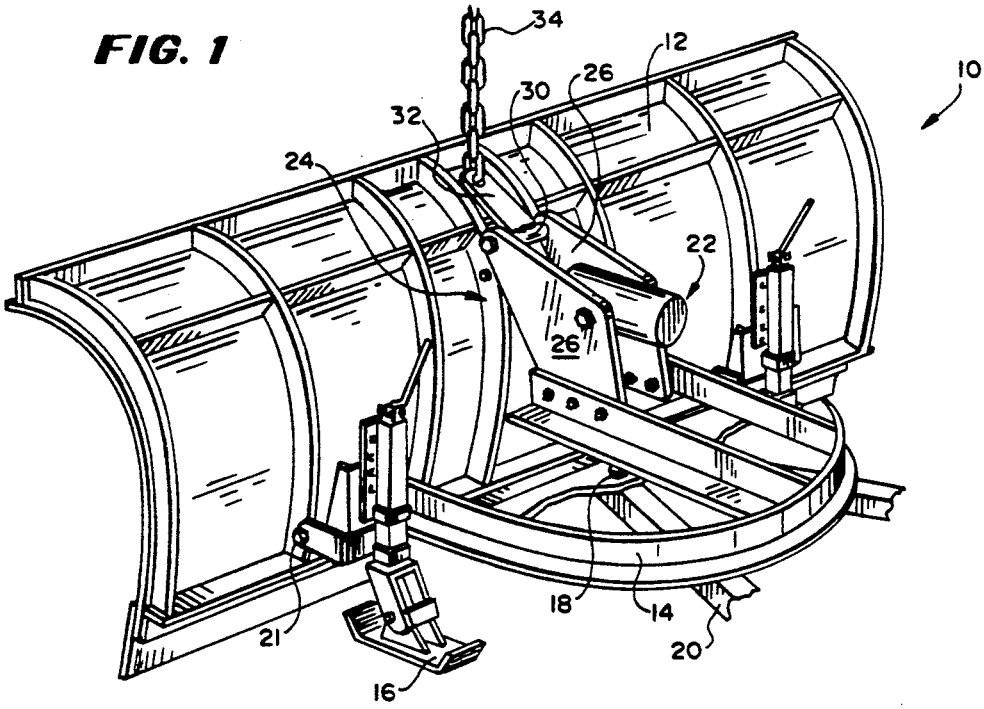
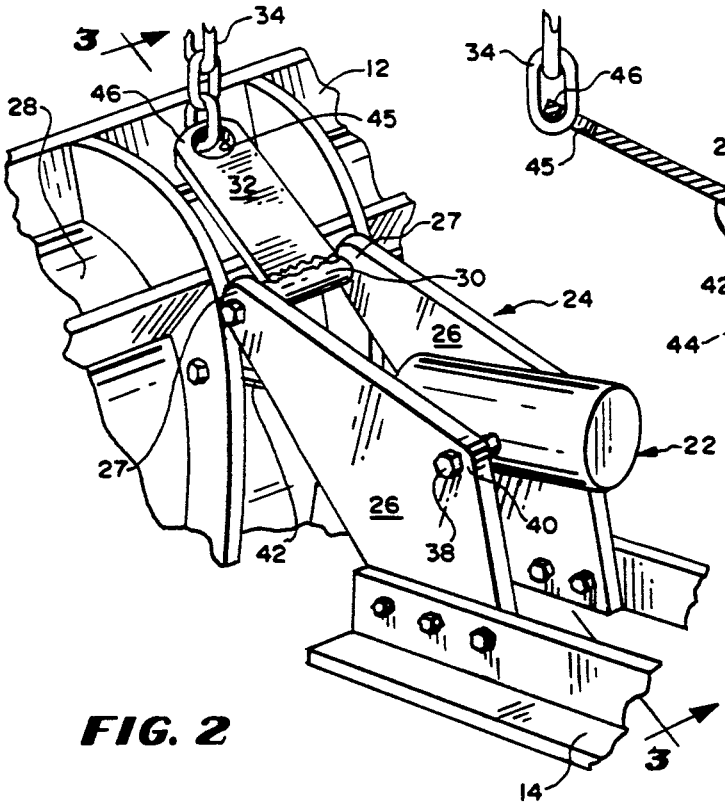
FIG. 2
FIG. 3
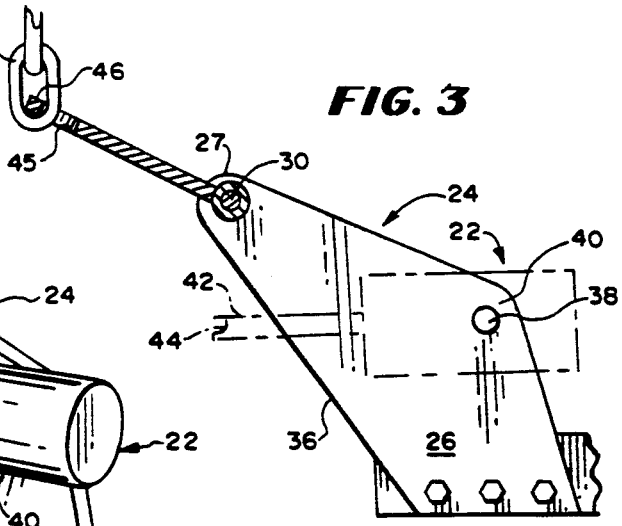

LEVEL LIFT FRAMEWORK FOR CANISTER TYPE PLOW PUSH FRAME

BACKGROUND OF THE INVENTION

The present invention relates to a framework which allows for level lifting of a plow blade incorporating a canister type push frame. More particularly, the framework provides for a single centered attachment of the framework to a lift chain for the plow frame, which allows for essentially level lifting and seating of the plow blade regardless of lateral angulation of the plow blade.

Prior Art

A difficulty in maintaining levelness of a plow blade at any degree of angulation thereof has always existed.

This difficulty arises because a plow blade is usually hung from an arm centered thereabove by two chains which radiate outwardly toward lateral ends of the plow blade from the centered point of attachment to the arm.

Upon any lateral swivel action of the plow blade about a pivot point thereof, one chain is always stressed while the other always slackens, with the plow blade becoming unlevel with respect to a surface therebeneath.

As will be described in greater detail hereinafter, the framework of the present invention allows for dependent mounting of a plow blade incorporating a canister type push frame from the arm thereabove by a chain which is centered relative to the lateral ends of the plow blade and which also positions the chain forward of a forward tilt pivot point for the plow blade.

BRIEF DESCRIPTION OF THE DRAWINGS

Other objects and advantages of the invention will become more apparent upon perusal of the detailed description thereof and upon inspection of the drawings in which:

FIG. 1 is a rear perspective view of a canister type push frame plow assembly including the framework of the present invention.

FIG. 2 is an enlarged perspective view of the area of the assembly of FIG. 1 including the framework.

FIG. 3 is a cross sectional view taken along line 3—3 of FIG. 2.

SUMMARY OF THE INVENTION

According to the invention there is provided a framework which engages to a canister type push frame of a plow assembly and extends forwardly and upwardly therefrom in a manner to be centered along the length of the blade of the plow assembly. The framework includes structure thereon which engages a centered chain for engagement to an arm above the plow blade, the framework extending forwardly to a distance which places the chain engaging structure forwardly of a forward tilt pivot of the plow assembly as well, as well as structure for engaging the canister arrangement thereto.

DESCRIPTION OF THE PREFERRED EMBODIMENT

Referring now to the drawings in greater detail, there is shown in FIGS. 1 and 2 a plow assembly 10.

The plow assembly 10 includes a plow blade 12 engaged to a push frame 14 in known manner. The frame 14 rides on skids 16 and is laterally pivotable about a point 18 where it engages arms 20 of a vehicle mounted swivel plate (not shown).

Further, the plow blade 12 is capable of tilting downwardly and forwardly about a secondary pivot point 21 about which the blade 12 is engaged to the push frame 14, the tilting being controlled by a canister type piston and cylinder arrangement 22.

Typically such a plow assembly 10 is dependingly engaged to a centered arm (not shown) extending forwardly of the vehicle to which the assembly 10 is attached by means of two chains, each of which extend radially outwardly to engage the push frame 14 in the area where the skids 16 are engaged.

Such two chain engagement causes the plow blade 12 to become unlevel when pivoted from the position shown, with the chain closer to one of the arms 20 becoming slack and causing a drooping of the associated end of the plow blade 12 and with the chain further from one of the arms 20 becoming stressed and raising the associated end of the plow blade 12, causing the blade 12 to be cocked relative to the surface therebeneath.

The canister type arrangement 22 is typically engaged to the push frame 14 by means of triangular side panels which elevate the canister type arrangement 22 to a position above the vertical centerline of the plow blade 12.

These side panels are modified to create the simple framework 24 of the present invention for allowing the plow blade 12 to be essentially level at all times.

The plow assembly 10 shown here incorporates the framework 24 made in accordance with the teachings of the present invention which substantially eliminates the cocking of the blade 12.

In this respect, the framework 24 comprises a simple structure including two side panels 26 which engage the push frame 14 and extend upwardly therefrom and forwardly therefrom, a forward elevated corner 27 of each side panel 26 terminating just behind and along a rear surface 28 of the plow blade 12, at a position forward of the pivot point 21 about which the plow blade 12 tilts.

Situated between and engaged to each forward elevated corner 27 of the side panels 26 is a rotatable rod or cross member 30.

The framework 24 is centered along the length of the plow blade 12 and the cross member 30 has at a centered position therealong an elongate radial tongue 32 from which, in the preferred embodiment, a single chain 34 extends.

A forward wall 36 of each side panel 26 is of such length as to ensure that the tongue 32 is forward of the tilt pivot point 21 of the assembly 10 when in an upright position thereof.

The canister type arrangement 22 is engaged by bolts 38 to a rear upper corner 40 of each side panel 26, with a piston 42 thereof extending forwardly therefrom, the free forward end 44 of the piston 42 engaging the rear surface 28 of the plow blade 12.

The framework 24 is preferably engaged to the push frame 14 by welding, by bolting, or by other suitable means. The tongue 32 is preferably engaged to the cross member 30 by welding and includes an opening 45 in a free end 46 thereof, within which a link of chain 34 is engaged.

When the plow blade 12 is engaged in the manner shown and the chain 34 is the only point of attachment for the plow blade 12 to the arm thereabove, the blade 12 tends to remain parallel and does not cock relative to the surface therebeneath, regardless of the angulation of the plow blade 12.

It will be understood that the framework 24 can be added to any existing canister type plow assembly 10.

As described above, the framework 22 provides a number of advantages, some of which have been described above and others of which are inherent in the invention.

Also, modifications may be proposed to the framework 24 without departing from the teachings of the present invention. For example, in the preferred embodiment disclosed, only one chain 34 is used. However, for a heavier or more cumbersome blade 12, it would be within the scope of the invention to provide two chains 34, substantially next to one another, to accommodate the blade 12.

Accordingly the scope of the invention is only to be limited as necessitated by the accompanying claims.

I claim:

1. A snow plow leveling system having a chain and canister type actuator comprising:

a push frame;

a plow blade pivotally attached to a forward portion of the push frame to form a tilt pivot point therebetween;

a framework attached to the push frame and extending above said plow blade forward of the tile pivot point, wherein said framework includes means, provided forwardly of the tilt pivot point, for engaging the chain and means for engaging the canister type actuator.

2. The framework of claim 1 comprising two side panels and an end rod engaged to and between said panels at a point forwardly of said forward tilt pivot point.

3. The framework of claim 2 wherein each said side panel includes a planar bottom edge which is engaged to a cooperating support arm of said push frame by bolting.

4. The framework of claim 3 wherein a rear wall of each side panel is slightly forwardly angulated.

5. The framework of claim 4 wherein a forward wall of each side panel forwardly angulated to an extent greater than that of the rear wall, the forward wall being significantly longer than said rear wall.

6. The framework of claim 5 wherein a top wall of each said side panels extends forwardly and upwardly from the rear wall to the forward wall.

7. The framework of claim 6 wherein each side panel has an opening in the upper rear corner thereof.

8. The framework of claim 7 wherein each side panel has an opening in the upper front corner thereof.

9. The framework of claim 8 wherein a rotatable rod is engaged to and between the openings in the upper front corners of the side walls.

10. The framework of claim 9 wherein said rod includes a radial tongue welded thereto, said tongue having an opening in a free end thereof.

11. The framework of claim 10 wherein said rear corner openings in said side walls engage bolts therein to which are mounted a canister type actuator for the plow blade, the actuator being suspended between the side walls.

* * * * *